US005487839A

United States Patent [19]

Vinci et al.

[11] Patent Number: 5,487,839

[45] Date of Patent: Jan. 30, 1996

[54] GREASE COMPOSITIONS

[75] Inventors: James N. Vinci, Mayfield Heights; Syed Q. A. Rizvi, Painesville; Carmen V. Luciani, Wickliffe, all of Ohio

[73] Assignee: The Lubrizol Corporation, Wickliffe, Ohio

[21] Appl. No.: 292,552

[22] Filed: Aug. 18, 1994

Related U.S. Application Data

[63] Continuation of Ser. No. 975,362, Nov. 12, 1992, abandoned, which is a continuation-in-part of Ser. No. 687,271, Apr. 18, 1991, abandoned.

[51] Int. Cl.[6] ..... C10M 139/00; C10M 137/00

[52] U.S. Cl. ..... 252/49.9; 252/38; 252/49.6; 252/49.8

[58] Field of Search ..... 252/49.9, 49.8, 252/49.6, 38

[56] References Cited

U.S. PATENT DOCUMENTS

| | | | |
|---|---|---|---|
| 2,257,601 | 9/1941 | Hail et al. | 252/53 |
| 2,270,241 | 1/1942 | Adams | 252/49.9 |
| 2,295,192 | 9/1942 | Arveson | 252/53 |
| 2,373,733 | 4/1945 | Adams et al. | 252/53 |
| 2,408,090 | 9/1946 | Musher | 252/49.9 |
| 2,465,733 | 3/1949 | Levis | 260/403 |
| 3,085,100 | 4/1963 | Franklin | 260/403 |
| 3,252,908 | 5/1966 | Coleman | 252/49.9 |
| 3,284,409 | 11/1966 | Dorer | 252/49.9 |
| 4,305,853 | 12/1981 | Kronstein | 260/22 |
| 4,522,629 | 6/1985 | Horodysky | 44/53 |
| 4,529,528 | 7/1985 | Horodysky | 252/49.6 |
| 4,536,306 | 8/1985 | Horodysky | 252/32 |
| 4,557,844 | 12/1985 | Horodysky | 252/49.9 |
| 4,582,617 | 4/1986 | Doner et al. | 252/32.7 |
| 4,599,185 | 7/1986 | Towers et al. | 252/32.5 |
| 4,599,191 | 7/1986 | Horodysky | 252/32.5 |
| 4,600,517 | 7/1986 | Doner et al. | 252/49.6 |
| 4,655,948 | 4/1987 | Doner et al. | 252/49.6 |
| 4,743,386 | 5/1988 | Doner et al. | 252/49.6 |
| 4,780,227 | 10/1988 | Doner et al. | 252/32.7 |
| 4,781,850 | 11/1988 | Doner et al. | 252/49.6 |
| 4,828,732 | 5/1989 | Doner et al. | 252/32.7 |
| 4,828,734 | 5/1989 | Doner et al. | 252/49 |
| 4,857,214 | 8/1989 | Papay et al. | 252/32.5 |
| 4,961,868 | 10/1990 | Doner et al. | 252/32.7 |
| 5,068,045 | 11/1991 | Doner et al. | 252/32.007 |
| 5,084,194 | 1/1992 | Doner et al. | 252/32.7 |
| 5,135,669 | 8/1992 | Brois et al. | 252/32.5 |

FOREIGN PATENT DOCUMENTS

| | | |
|---|---|---|
| 0325977 | 1/1989 | European Pat. Off. . |
| 2125431 | 7/1983 | United Kingdom . |

OTHER PUBLICATIONS

Smalheer et al, Lubricant Additives, pp. 1–11, 1967.

Witte, A. C. "Technology of Modern Greases", Lubrication, vol. 77, No. 1, (1991) pp. 1–16 (Month N/A).

NLGI Lubricating Grease Guide, Revised 1987, National Lubricating Grease Institute, Kansas City, Mo., pp. 1.05–1.12 and 4.08–4.11 (Month N/A).

*Primary Examiner*—Ellen M. McAvoy

*Attorney, Agent, or Firm*—Joseph P. Fischer; Frederick D. Hunter; James L. Cordek

[57] ABSTRACT

This invention relates to improved grease compositions comprising a major amount of an oil based simple metal soap thickened base grease and a minor amount of at least one phosphorus and boron containing composition, said phosphorus and boron containing composition prepared by reacting a combination of (A) at least one boron compound and (B) at least one phospholipid. In one embodiment, the phosphorus and boron containing composition is present in amounts sufficient to improve the extreme pressure, anti-wear and lubricity properties of the base grease. In another embodiment the phosphorus and boron containing composition is present in amounts sufficient to increase the dropping point of the base grease, as determined by ASTM procedure D-2265, by at least 20° C.

36 Claims, No Drawings

GREASE COMPOSITIONS

This is a continuation of application Ser. No. 07/975,362 filed on Nov. 12, 1992 now abandoned, which is a continuation-in-part of application Ser. No. 07/687,271 filed on Apr. 18, 1991, now abandoned.

FIELD OF THE INVENTION

This invention relates to grease compositions. More particularly, it relates to metal soap thickened base greases containing certain boron- and phosphorus-containing property-improving additives.

BACKGROUND OF THE INVENTION

Man's need to reduce friction dates back to ancient times. As far back as 1400 B.C., both mutton fat and beef fat (tallow) were used in attempts to reduce axle friction in chariots.

Until the mid-1800's, lubricants continued to be primarily mutton and beef fats, with certain types of vegetable oils playing minor roles. In 1859, however, Colonel Drake drilled his first oil well. Since that time most lubricants, including greases, have been based on petroleum ("mineral") oil, although synthetic oil based lubricants are used for special applications.

In the *NLGI Lubricating Grease Guide,* © 1987, available from the National Lubricating Grease Institute, Kansas City, Mo., USA, is a detailed discussion of greases, including various types of thickeners. Such thickeners include metal soaps, complex metal salt-metal soaps and non-soaps.

Metal soap thickened greases have provided exemplary performance. Performance of greases may be enhanced by incorporating therein various types of additives. In A. C. Witte, *Lubrication,* Vol. 77, No. 1, Texaco Inc., White Plains, N.Y., (1991), pp 2–3, is a discussion of additives for greases, including antioxidants, rust and corrosion inhibitors, EP (extreme pressure) additives, antiwear additives, lubricity agents, tackifiers and fillers.

Dropping point is one measure of the thermal stability of a grease. One way to increase the dropping point of base greases is to convert a simple metal soap grease to a complex grease by incorporating therein certain acids, typically carboxylic acids such as acetic acid, alpha-omega-dicarboxylic acids and certain aromatic acids. This additional step necessarily consumes considerable time resulting in reduced production.

Doner et al, in a series of US Patents, specifically, U.S. Pat. Nos.

| | | |
|---|---|---|
| 5,084,194 | 5,068,045 | 4,961,868 |
| 4,828,734 | 4,828,732 | 4,781,850 |
| 4,780,227 | 4,743,386 | 4,655,948 |
| 4,600,517 | 4,582,617 | |

teaches increased thickening of metal salt thickened base greases is obtained by employing certain boron-containing compounds. Other additives contemplated by Doner et al for use with boron-containing compounds are phosphorus- and sulfur-containing materials, particularly zinc dithiophosphates.

SUMMARY OF THE INVENTION

This invention relates to improved grease compositions comprising a major amount of an oil based simple metal soap thickened base grease and a minor amount of at least one phosphorus and boron containing composition, said phosphorus and boron containing composition prepared by reacting a combination of (A) at least one boron compound and (B) at least one phospholipid. In one embodiment, the phosphorus and boron containing composition is present in amounts sufficient to improve the extreme pressure, antiwear and lubricity properties of the base grease. In another embodiment the phosphorus and boron containing composition is present in amounts sufficient to increase the dropping point of the base grease, as determined by ASTM procedure D-2265, by at least 20° C.

The greases of this invention are useful for lubricating, sealing and protecting mechanical components such as gears, axles, bearings, shafts, hinges and the like. Such mechanical components are found in automobiles, trucks, bicycles, steel mills, mining equipment, railway equipment including rolling stock, aircraft, boats, construction equipment and numerous other types of industrial and consumer machinery.

To meet the requirements of these and other applications, greases must provide, to varying degrees, lubricity, extreme pressure and antiwear properties and depending upon the application, acceptable thermal stability (heat resistance).

DETAILED DESCRIPTION OF THE INVENTION

Extreme pressure performance of a grease permits the grease to perform under high load conditions, particularly, under boundary conditions. Typically, a base grease, without extreme pressure property improving additives, is unable to provide acceptable extreme pressure properties.

Likewise, a lubricating grease should provide protection against undesirable wear of the lubricated parts. Chemical additives are frequently used to enhance antiwear performance of a base grease.

Oil-based greases inherently provide a certain degree of lubricity. Lubricity properties of a base grease may be enhanced by incorporating therein certain lubricity improving additives.

These properties are measured by well-known tests such as the Timken OK Load test (ASTM D-2509), the Shell 4-Ball test (e.g., ASTM D-2596) and other such tests.

Heat resistance of greases is measured in a number of ways. One measure of heat resistance is the dropping point. Grease typically does not have a sharp melting point but, rather, softens until it no longer functions as a thickened lubricant. The American Society for Testing and Materials (1916 Race Street, Philadelphia, Pa.) has set forth a test procedure, ASTM D-2265, which provides a means for measuring the dropping point of greases.

In general, the dropping point of a grease is the temperature at which the grease passes from a semisolid to a liquid state under the conditions of the test. The dropping point is the temperature at which the first drop of material falls from the test cup employed in the apparatus used in ASTM procedure D-2265.

For many applications simple metal soap thickened base greases are entirely satisfactory. However, for some applications, greater heat resistance manifested by a dropping point above that obtained employing simple metal soap thickened greases is desirable.

Complex metal soap greases provide increased dropping point, but have a number of significant drawbacks. Complex thickeners have incorporated therein, in addition to a fatty acid component, a non-fatty acid, e.g., benzoic, organic dibasic acids, etc. component. The formation of the complex grease typically involves the additional step of reaction of the non-fatty acid with the simple metal soap, and requires extended heating periods, sometimes several times that required to prepare a simple metal soap thickened grease. Accordingly, it is desirable to provide a means for preparing a simple metal soap thickened grease composition having dropping points approaching or even exceeding those possessed by complex greases.

Thus, it is an object of this invention to provide novel grease compositions.

It is a further object of this invention to provide grease compositions having valuable properties.

It is another object of this invention to provide grease compositions improved with respect to extreme pressure, antiwear and lubricity properties.

It is another object of this invention to provide grease compositions having improved thermal (heat) stability as indicated by an increased dropping point as measured by ASTM Procedure D-2265.

It is another object of this invention to provide greases having improved thermal stability without the need for an additional processing step.

Other objects will become apparent to the skilled person upon reading the specification and description of this invention.

In one embodiment, the grease compositions of this invention display improved extreme pressure properties when compared to the base grease. In another embodiment, the grease compositions display improved antiwear properties and in a still further embodiment, they display improved lubricity.

The grease compositions of this invention also may display dropping points at least 20° C. greater than the dropping point of the corresponding oil based simple metal soap thickened base grease. This benefit is obtained by incorporating into the simple metal soap thickened base grease certain boron and phosphorus containing compositions as described herein in amounts sufficient to increase the dropping point of the corresponding base grease by at least about 20° C. as measured by ASTM Procedure D-2265.

Frequently, incorporating the boron and phosphorus compositions described herein into the base grease improves two or more of the aforementioned properties.

Greases are frequently exposed to water. Thus, it is desirable that general purpose greases be substantially free of components that are readily adversely affected by water.

Many boron-containing compounds are sensitive to water, either being water-soluble, being subject to leaching from the grease into water or being readily hydrolyzed yielding undesirable hydrolysis products or to hydrolysis products which readily leach out into water. Surprisingly, the phosphorus and boron containing compositions employed in the grease composition of this invention do not display objectionable water sensitivity.

Greases are typically prepared by thickening an oil basestock. The greases of this invention are oil-based, that is, they comprise an oil which has been thickened with a metal soap thickener.

The grease compositions of this invention employ an oil of lubricating viscosity, including natural or synthetic lubricating oils and mixtures thereof. Natural oils include animal oils, vegetable oils, mineral oils, solvent or acid treated mineral oils, and oils derived from coal or shale. Synthetic lubricating oils include hydrocarbon oils, halo-substituted hydrocarbon oils, alkylene oxide polymers, esters of carboxylic acids and polyols, esters of polycarboxylic acids and alcohols, esters of phosphorus-containing acids, polymeric tetrahydrofurans, silicone-based oils and mixtures thereof.

Specific examples of oils of lubricating viscosity are presented in U.S. Pat. No. 4,326,972 and European Patent Publication 107,282, both herein incorporated by reference for their disclosures relating to lubricating oils. A basic, brief description of lubricant base oils appears in an article by D. V. Brock, "Lubricant Base Oils" *Lubricant Engineering,* volume 43, pages 184–185, March 1987. This article is herein incorporated by reference for its disclosures relating to lubricating oils. A description of oils of lubricating viscosity occurs in U.S. Pat. No. 4,582,618 (Davis) (column 2, line 37 through column 3, line 63, inclusive), herein incorporated by reference for its disclosure to oils of lubricating viscosity.

Another source of information regarding oils used to prepare lubricating greases is *NLGI Lubricating Grease Guide,* National Lubricating Grease Institute, Kansas City, Mo. (1987), pp 1.06–1.09, and A. C. Witte, *Lubrication,* Vol. 77, No. 1, Texaco, Inc., White Plans, N.Y. (1991), pg. 2 both of which are expressly incorporated herein by reference.

The simple metal soap thickeners employed in the greases of this invention are well-known in the art. These metal soaps are incorporated into a base oil, typically an oil of lubricating viscosity, in amounts, typically from about 1 to about 30% by weight, more often from about 1 to about 15% by weight, of the base grease composition. In many cases, the amount of metal soap used to thicken the base oil constitutes from about 5% to about 25% of the total by weight of base grease. In other cases from about 2% to about 15% by weight of metal soap is present in the base grease.

The specific amount of metal soap required often depends on the metal soap employed. The type and amount of metal soap employed is frequently dictated by the desired nature of the grease.

The type and amount of metal soap employed is also dictated by the desired consistency, which is a measure of the degree to which the grease resists deformation under application of force. Consistency is usually indicated by the ASTM Cone penetration test, ASTM D-217 or ASTM D-1403.

Types and amounts of simple metal soap thickeners to employ are well-known to those skilled in the grease art. They are substantially neutral, as defined herein, metal salts of fatty group containing acids. The aforementioned *NLGI Lubricating Grease Guide,* pp 1.09–1.11 and the aforementioned article by Witte in *Lubrication,* pp 1–2, 3–4 and 7, provide descriptions of many simple metal soap thickeners. These texts are hereby incorporated herein by reference for their disclosure of simple metal soap grease thickeners.

As indicated hereinabove the grease compositions of this invention are oil based, including both natural and synthetic oils. Greases are made from these oils by adding a thickening agent thereto or by forming the thickener therein. Thickening agents useful in the greases of this invention are the simple metal soaps. By simple metal soaps is meant the substantially stoichiometrically neutral metal salts of fatty acids. By substantially stoichiometrically neutral is meant that the metal salt contains from about 90% to about 110% of the metal required to prepare the stoichiometrically neutral salt, preferably from about 95% to about 105%, more preferably from about 99% to about 101%.

Fatty acids are defined herein as carboxylic acids containing from about 8 to about 24, preferably from about 12 to about 18 carbon atoms. The fatty acids are usually monocarboxylic acids. Examples of useful fatty acids are capric, palmitic, stearic, oleic and others. Mixtures of acids are useful. Preferred carboxylic acids are linear; that is they are substantially free of hydrocarbon branching. By substantially free of hydrocarbon branching means that no more than one hydrocarbon substituent (e.g., methyl, ethyl, etc.) occurs for each 6 carbon atoms in a linear chain.

Particularly useful acids are the hydroxy-substituted fatty acids such as hydroxy stearic acid wherein one or more hydroxy groups may be located at positions internal to the carbon chain, such as 12-hydroxy-, 14-hydroxy- etc. stearic acids.

While the soaps are fatty acid salts, they need not be, and frequently are not, prepared directly from fatty acids. The typical grease-making process involves saponification of a fat which is often a glyceride or of other esters such as methyl or ethyl esters of fatty acids, preferably methyl esters, which saponification is generally conducted in situ in the base oil making up the grease.

Whether the metal soap is prepared from a fatty acid or an ester such as a fat, greases are often prepared in a grease kettle, forming a mixture of the base oil, fat, ester or fatty acid and metal-containing reactant to form the soap in-situ. Continuous processes are also available. Additives for use in the grease may be present or added during base grease manufacture, but are often added following formation of the base grease.

The metals of the metal soaps are typically alkali metals, alkaline earth metals and aluminum. For purposes of cost and ease of processing, the metals are incorporated into the thickener by reacting the fat, ester or fatty acid with basic metal containing reactants such as oxides, hydroxides, carbonates and alkoxides (typically lower alkoxides, those containing from 1 to 7 carbon atoms in the alkoxy group). The soap may also be prepared from the metal itself although many metals are either too reactive or insufficiently reactive with the fat, ester or fatty acid to permit convenient processing.

Preferred metals are lithium, sodium, calcium, magnesium, barium and aluminum. Especially preferred are lithium, sodium and calcium; lithium is particularly preferred.

Preferred fatty acids are stearic acid, palmitic acid, oleic and their corresponding esters, including glycerides (fats). Hydroxy-substituted acids and the corresponding esters, including fats, are particularly preferred.

These and other thickening agents are described in U.S. Pat. Nos. 2,197,263; 2,564,561 and 2,999,066, the aforementioned *NLGI Lubricating Grease Guide,* and the aforementioned article by Witte, in *Lubrication,* all of which are incorporated herein by reference for relevant disclosures of grease thickeners, Complex greases, e.g., base greases containing metal soap-salt complexes such as metal soap-acetates, metal soap- dicarboxylates, etc. are not simple metal soap thickened greases as defined herein.

The phosphorus and boron containing compositions employed in the grease compositions of this invention are prepared by reacting a combination of (A) boron compounds and (B) phospholipids. The combination may also include (C) an amine, (D) an acylated nitrogen compound, (E) a carboxylic ester, (F) Mannich reaction products, (G) a basic nitrogen containing polymer, or (H) a basic or neutral metal salt of an organic acid provided that when the acylated nitrogen compound (D) has a substituent with at least an average of forty carbon atoms, then the boron compound (A) is reacted with the phospholipid (B) to form an intermediate and the intermediate is reacted with (D). These reaction products are useful as additives for oil-based lubricants, including greases. These materials act as anti-wear, extreme pressure and friction modifying agents. In simple metal soap thickened oil-based greases these products, when employed in sufficient amounts in the grease, also increase the dropping point of the base grease.

Phospholipids, sometimes referred to as phosphatides and phospholipins, are lipids which contain a phosphoric acid or derivative thereof. Glycerophospholipids, have been referred to as phosphatides and phosphoglycerides, are any glycerophosphoric acid or derivative thereof with one or two acyl, alkenyl or alkyl groups attached to a glycerol residue. These materials may be prepared synthetically or may be derived from natural sources. Natural sources that produce phospholipids are commonly seeds as well as animal products such as eggs.

As used herein, the term "hydrocarbyl" or "hydrocarbyl group" denotes a group having a carbon atom directly attached to the remainder of the molecule and having predominantly hydrocarbon character within the context of this invention. Thus, the term "hydrocarbyl" includes hydrocarbon, as well as substantially hydrocarbon groups. Substantially hydrocarbon describes groups, including hydrocarbon based groups which contain non-hydrocarbon substituents, or non-carbon atoms in a ring or chain which do not alter the predominantly hydrocarbon nature of the group.

Hydrocarbyl groups can contain up to three, preferably up to two, more preferably up to one, non-hydrocarbon substituent, or non-carbon heteroatom in a ring or chain, for every ten carbon atoms provided this non-hydrocarbon substituent or non-carbon heteroatom does not significantly alter the predominantly hydrocarbon character of the group. Those skilled in the art will be aware of such heteroatoms, such as oxygen, sulfur, phosphorus and nitrogen, or substituents, which include, for example, hydroxyl, halo (especially chloro and fluoro), alkyoxyl, alkyl mercapto, alkyl sulfoxy, etc.

Examples of hydrocarbyl groups include, but are not necessarily limited to, the following:

(1) hydrocarbon groups, that is, aliphatic (e.g., alkyl or alkenyl), alicyclic (e.g., cycloalkyl, cycloalkenyl) groups, aromatic groups (e.g., phenyl, naphthyl), aromatic-, aliphatic- and alicyclic-substituted aromatic groups and the like as well as cyclic groups wherein the ring is competed through another portion of the molecule (that is, for example, any two indicated groups may together form an alicyclic radical);

(2) substituted hydrocarbon groups, that is, those groups containing non-hydrocarbon containing substituents or atoms other than carbon attached to the hydrocarbon group which, in the context of this invention, do not significantly alter the predominantly hydrocarbon character; those skilled in the art will be aware of such groups (e.g., halo (especially chloro and fluoro), hydroxy, alkoxy, mercapto, alkylmercapto, nitro, nitroso, sulfoxy, etc.);

(3) hetero atom containing groups, that is, groups which will, while having a predominantly hydrocarbon character within the context of this invention, contain heteroatoms in a ring or chain otherwise composed of carbon atoms. Suitable heteroatoms will be apparent to those of ordinary skill in the art and include, for example, sulfur, oxygen, nitrogen and phosphorus. Such groups as, e.g., pyridyl, furyl, thienyl, imidazolyl, etc. are representative of heteroatom containing cyclic groups.

Typically, no more than about 2, preferably no more than one, non-hydrocarbon substituent, or heteroatom in a chain or ring, will be present for every ten carbon atoms in the hydrocarbyl group. Usually, however, the hydrocarbyl groups are purely hydrocarbon and are substantially free of non-hydrocarbon groups, substituents or heteroatoms.

Unless indicated otherwise, hydrocarbyl groups may be saturated or unsaturated. Saturated groups include those which are substantially saturated. By substantially saturated it is meant that the group contains no more than one carbon-to-carbon unsaturated bond, olefinic unsaturation, for every ten carbon-to-carbon bonds present. Often, they contain no more than one carbon-to-carbon non-aromatic unsaturated bond for every 50 carbon-to-carbon bonds present. Frequently, hydrocarbyl groups are substantially free of carbon to carbon unsaturation. It is to be understood that, within the context of this invention, aromatic unsaturation is not normally considered to be olefinic unsaturation. That is, aromatic groups are not considered as having carbon-to-carbon unsaturated bonds.

(A) Boron Compounds

The grease compositions of this invention comprise compositions prepared by reacting a combination of (A) a boron compound and (B) a phospholipid. The boron compounds include boron oxide, boron oxide hydrate, boron trioxide, boron trifluoride, boron tribromide, boron trichloride, boron acids such as boronic acid (i.e., alkyl-$B(OH)_2$ or aryl-$B(OH)_2$), including methyl boronic acid, phenyl-boronic acid, cyclohexyl boronic acid, p-heptylphenyl boronic acid and dodecyl boronic acid, boric acid (i.e., $H_3BO_3$), tetraboric acid (i.e., $H_2B_4O_7$), metaboric acid (i.e., $HBO_2$), boron anhydrides, boron amides and various esters of such boron acids. The use of complexes of boron trihalide with ethers, organic acids, inorganic acids, or hydrocarbons is a convenient means of introducing the boron reactant into the reaction mixture. Such complexes are known and are exemplified by boron-trifluoride-triethyl orthoester, boron trifluoride-phosphoric acid, boron trichloride-chloroacetic acid, boron tribromide-dioxane, and boron trifluoridemethyl ethyl ether complexes.

The boron acid esters include especially mono-, di-, and tri-organic esters of boric acid with alcohols or phenols such as, e.g., methanol, ethanol, propanol, 1-octanol, benzyl alcohol, ethylene glycol, glycerol, Cellosolve, and phenol. Lower alcohols, 1,2-glycols, and 1,3-glycols, i.e., those having less than about 8 carbon atoms are especially useful for preparing the boric acid esters for the purpose of this invention. Methods for preparing the esters of boron acid are known and disclosed in the art (such as "Chemical Reviews, pp. 959–1064, Vol. 56).

(B) Phospholipids

The phospholipids (B) of the present invention may be any lipid containing a phosphorus derivative, such as a phosphoric acid or ester, such as lecithin or cephalin, preferably lecithin or derivatives thereof. Examples of phospholipids include phosphatidylcholine, phosphatidylserine, phosphatidylinositol, phosphatidylethanolamine, phosphotidic acid and mixtures thereof. Preferably, the phospholipids are glycerophos-pholipids, more preferably, glycero derivatives of the above list of phospholipids. Typically, the glycerophospholipids have one or two acyl, alkyl or alkenyl groups on a glycerol residue. The alkyl or alkenyl groups generally contain from about 8 to about 30 carbon atoms, preferably 8 to about 25, more preferably 12 to about 24. Example of these groups include octyl, dodecyl, hexadecyl, octadecyl, docosanyl, octenyl, dodecenyl, hexadecenyl and octadecenyl.

The acyl groups on the glycerophospholipids are generally derived from fatty acids. Fatty acids are acids having from about 8 to about 30 carbon atoms, preferably about 12 to about 24, more preferably about 12 to about 18. Examples of fatty acids include myristic, palmitic, stearic, oleic, linoleic, linolenic, arachidic, arachidonic acids, or mixtures thereof, preferably stearic, oleic, linoleic, and linolenic acids or mixtures thereof.

In the present invention, derivatives of phospholipids may also be used. Derivatives of phospholipids may be acylated or hydroxylated phospholipids. For instance, lecithin as well as acylated and hydroxylated lecithins may be used in the present invention. Acylated lecithins may be prepared by reacting an acylating agent with a lecithin. Acylating agents include acetic acid. An example of an acylated lecithin is Thermolec 200 acylated soya lecithin available from Ross & Rowe, Inc. of Decatur, Ill. Hydroxylated lecithins may also be used. Hydroxylated lecithins may be prepared by acidic or enzymatic hydrolysis. An example of hydroxylated lecithins is Thermolec 1018 hydroxylated lecithin available from Ross & Rowe, Inc.

Phospholipids may be prepared synthetically or derived from natural sources. Synthetic phospholipids may be prepared by methods known to those in the art. Naturally derived phospholipids are extracted by procedures known to those in the art. Phospholipids may be derived from animal or vegetable sources. The animal sources include fish, fish oil, shellfish, bovine brain or any egg, preferably chicken eggs. Vegetable sources include rapeseed, sunflower seed, peanut, palm kernel, cucurbit seed, wheat, barley, rice, olive, mango, avocado, palash, papaya, jangli, bodani, carrot, soybean, corn, and cottonseed, more preferably soybean, corn, sunflower and cottonseed. Phospholipids may be derived from microorganisms, including blue-green algae, green algae, bacteria grown on methanol or methane and yeasts grown on alkanes.

A useful phospholipid is derived from sunflower seeds. The phospholipid typically contains from about 35 to about 60% phosphatidylcholine, from about 20 to about 35% phosphatidylinositol, from about 1 to about 25% phosphatidic acid and from about 10 to about 25% phosphatidylethanolamine, wherein the percentages are by weight based on the total phospholipids. The fatty acid content is typically about 20–30% by weight palmitic acid, from about 2–10% by weight stearic acid, from about 15–25% by weight oleic acid and from about 40–55% by weight linoleic acid. In one embodiment, the phospholipid is derived from high oleic content sunflower seeds. These seeds typically produce phospholipids having oleic content greater than about 75%, preferably about 80%, more preferably about 85%. The fatty acid content of phospholipids derived from high oleic sunflower seeds generally range from about 3.5–4.5% palmitic acid, about 3.0–5.5% stearic acid, about 75–95% oleic acid and about 5– 15% linoleic acid. Generally, the phospholipid is derived from a meal produced from high oleic content sunflower seeds. The meal is available commercially under the tradename TRISUN® high oleic sunflower meal available from SVO Enterprises, 35585-B Curtis Boulevard, Eastlake, Ohio 44095.

In one embodiment, phospholipids included in the present invention are represented by one of the formulae

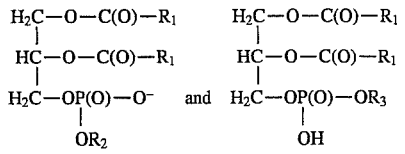

or mixtures thereof, wherein each $R_1$ is independently a hydrocarbyl group and each $R_2$ is independently selected from $—CH_2CH_2N^+(CH_3)_3$, $—CH_2CH_2N^+H_3$, $—CH_2CH(N^+H_3)COOH$, or, mixtures thereof, and each $R_3$ is independently $—C_6H_6(OH)_6$, hydrogen or mixtures thereof. Preferably each R is independently an alkyl, alkenyl or acyl group which have been described above.

Phospholipids and lecithins are described in detail in Encyclopedia of Chemical Technology, Kirk and Othmer, 3rd Edition, in "Fats and Fatty Oils", Volume 9, pages 795–831 and in "Lecithins", Volume 14, pages 250–269. The above disclosures of phospholipids and lecithins are hereby incorporated by reference.

In one embodiment, the combination, used to prepare the compositions of the present invention, further comprises (C) at least one amine, (D) an acylated nitrogen-containing compound, (E) a carboxylic ester, (F) a Mannich reaction product or (G) a neutral or basic metal salt of an organic acid provided that when the acylated nitrogen compound (D) has a substituent with at least an average of forty carbon atoms, then the boron compound (A) is reacted with the phospholipid (B) to form an intermediate and the intermediate is reacted with (D).

(C) Amines

The amines include ammonia, monoamines or polyamines. The monoamines generally contain from 1 to about 24 carbon atoms, preferably 1 to about 12, and more preferably 1 to about 6. Examples of monoamines useful in the present invention are substantially hydrocarbon-based amines which may be primary amines, secondary amines and tertiary amines.

In another embodiment, the monoamine may be a hydroxy-hydrocarbyl amine. Typically, the hydroxyhydrocarbylamines are primary, secondary or tertiary alkanolamines or mixtures thereof. Such amines can be represented by the formulae:

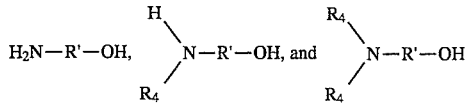

wherein each $R_4$ is independently a hydrocarbyl group of one to about eight carbon atoms or hydroxyhydrocarbyl group of two to about eight carbon atoms, preferably one to about four, and R' is a divalent hydrocarbyl group of about two to about 18 carbon atoms, preferably two to about four. The group —R'—OH in such formulae represents the hydroxyhydrocarbyl group. R' can be an acyclic, alicyclic or aromatic group. Typically, R' is an acyclic straight or branched alkylene group. Where two R groups are present in the same molecule they can be joined by a direct carbon-to-carbon bond or through a heteroatom (e.g., oxygen, nitrogen or sulfur) to form a 5-, 6-, 7- or 8-membered heterocyclic ring structure. Typically, however, each R group is independently a methyl, ethyl, propyl, butyl, pentyl or hexyl group.

The hydroxyhydrocarbylamines can also be an ether N-(hydroxyhydrocarbyl)amine. These are hydroxypoly(hydrocarbyloxy) analogs of the above-described hydroxy amines (these analogs also include hydroxyl-substituted oxyalkylene analogs). Such N-(hydroxyhydrocarbyl)amines can be conveniently prepared by reaction of epoxides with the aforedescribed amines and can be represented by the formulae:

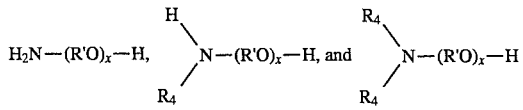

wherein x is a number from about 2 to about 15 and $R_4$ and R' are as described above. $R_4$ may also be a hydroxypoly(hydrocarbyloxy) group.

The amine may also be a polyamine. The polyamine may be aliphatic, cycloaliphatic, heterocyclic or aromatic. Examples of the polyamines include alkylene polyamines, hydroxy containing polyamines, arylpolyamines, and heterocyclic polyamines.

Alkylene polyamines are represented by the formula

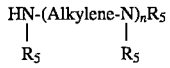

wherein n has an average value between about 1 and about 10, preferably about 2 to about 7, more preferably about 2 to about 5, and the "Alkylene" group has from 1 to about 10 carbon atoms, preferably about 2 to about 6, more preferably about 2 to about 4. $R_5$ is independently preferably hydrogen; or an aliphatic or hydroxy-substituted aliphatic group of up to about 30 carbon atoms. Preferably $R_5$ is defined the same as $R_4$.

Higher homologs obtained by condensing two or more of the alkylene amines are similarly useful as are mixtures of two or more of the polyamines.

Ethylene polyamines, such as some of those mentioned above, are useful. Such polyamines are described in detail under the heading Ethylene Amines in Kirk Othmer's "Encyclopedia of Chemical Technology", 2d Edition, Vol. 7, pages 22–37, Interscience Publishers, New York (1965). Such polyamines are most conveniently prepared by the reaction of ethylene dichloride with ammonia or by reaction of an ethylene imine with a ring opening reagent such as water, ammonia, etc. These reactions result in the production of a complex mixture of polyalkylenepolyamines including cyclic condensation products such as the aforedescribed piperazines. Ethylene polyamine mixtures are useful.

Other useful types of polyamine mixtures are those resulting from stripping of the above-described polyamine mixtures to leave as residue what is often termed "polyamine bottoms". In general, alkylene polyamine bottoms can be characterized as having less than 2%, usually less than 1% (by weight) material boiling below about 200° C. A typical sample of such ethylene polyamine bottoms obtained from the Dow Chemical Company of Freeport, Tex. designated "E-100" has a specific gravity at 15.6° C. of 1.0168, a percent nitrogen by weight of 33.15 and a viscosity at 40° C. of 121 centistokes. Gas chromatography analysis of such a sample contains about 0.93% "Light Ends" (most probably diethylenetriamine), 0.72% triethylene tetraamine, 21.74% tetraethylene pentaamine and 76.61% pentaethylene hexamine and higher (by weight). These alkylene polyamine bottoms include cyclic condensation products such as piperazine and higher analogs of diethylenetriamine, triethylenetetramine and the like.

Another useful polyamine is a condensation reaction product between at least one hydroxy compound with at least one polyamine reactant containing at least one primary or secondary amino group. The hydroxy compounds are preferably polyhydric alcohols and amines. Polyamine reactants, which react with the polyhydric alcohol or amine to form the condensation products or condensed amines, are described above. Preferably the hydroxy compounds are polyhydric amines.

The amine condensates and methods of making the same are described in U.S. Pat. No. 5,053,152 which is incorporated by reference for its disclosure to the condensates and methods of making.

In another embodiment, the amine is a polyalkene-substituted amine. These polyalkene-substituted amines are well known to those skilled in the art. These amines are disclosed in U.S. Pat. Nos. 3,275,554; 3,438,757; 3,454,555; 3,565,804; 3,755,433; and 3,822,289. These patents are hereby incorporated by reference for their disclosure of hydrocarbyl amines and methods of making the same.

(D) Acylated Nitrogen-Containing Compounds

The combination may also include an acylated nitrogen-containing compound. The acylated nitrogen-containing compounds include reaction products of hydrocarbyl-substituted carboxylic acylating agents such as substituted carboxylic acids or derivatives thereof. These compounds include imides, amides, amidic acid or salts, heterocycles (imidazolines, oxazolines, etc.), and mixtures thereof. In one embodiment, these compounds are useful as dispersants in lubricating compositions and have been referred to as nitrogen-containing carboxylic dispersants.

The conditions, i.e., temperature, agitation, solvents, and the like, for reacting an acid reactant with a polyalkene, are known to those in the art. Examples of patents describing various procedures for preparing useful acylating agents include U.S. Pat. Nos. 3,215,707 (Rense); 3,219,666 (Norman et al); 3,231,587 (Rense); 3,912,764 (Palmer); 4,110,349 (Cohen); and 4,234,435 (Meinhardt et al); and U.K. 1,440,219. The disclosures of these patents are hereby incorporated by reference.

(E) Carboxylic Ester

In another embodiment, the combination, which forms the compositions employed in the grease compositions of the present invention, may also include a carboxylic ester. These compounds are prepared by reacting at least one of the above described hydrocarbyl-substituted carboxylic acylating agents with at least one organic hydroxy compound. In another embodiment, the ester dispersant is prepared by reacting the acylating agent with the above-described hydroxyamine. The carboxylic ester may be further reacted with any of the above-described amines.

The preparation of useful carboxylic ester dispersant is described in U.S. Pat. Nos. 3,522,179 and 4,234,435.

The carboxylic esters may be further reacted with at least one of the above described amines and preferably at least one of the above described polyamines. These nitrogen-containing carboxylic ester dispersant compositions are known in the art, and the preparation of a number of these derivatives is described in, for example, U.S. Pat. Nos. 3,957,854 and 4,234,435 which have been incorporated by reference previously.

The carboxylic esters and methods of making the same are known in the art and are disclosed in U.S. Pat. Nos. 3,219,666, 3,381,022, 3,522,179 and 4,234,435 which are hereby incorporated by reference for their disclosures of the preparation of carboxylic ester dispersants.

(F) Mannich Reaction Products

The combination may also include a Mannich product. Mannich products are formed by the reaction of at least one aldehyde, at least one of the above described amine and at least one hydroxyaromatic compound. The reaction may occur from room temperature to 225° C., usually from 50° to about 200° C. (75° C.–125° C. most preferred), with the amounts of the reagents being such that the molar ratio of hydroxyaromatic compound to aldehyde to amine is in the range from about (1:1:1) to about (1:3:3).

Mannich products are described in the following patents: U.S. Pat. No. 3,980,569; U.S. Pat. No. 3,877,899; and U.S. Pat. No. 4,454,059 (herein incorporated by reference for their disclosure to Mannich products).

(G) Basic Nitrogen Containing Polymers

The reaction product may also include a basic nitrogen-containing polymer. These polymers include polymer backbones which are functionalized by reacting with an amine source. A true or normal block copolymer or a random block copolymer, or combinations of both are utilized.

It is often preferred that these block copolymers, for reasons of oxidative stability, contain no more than about 5 percent and preferably no more than about 0.5 percent residual olefinic unsaturation on the basis of the total number of carbon-to-carbon covalent linkages within the average molecule. Such unsaturation can be measured by a number of means well known to those of skill in the art, such as infrared, NMR, etc. Most preferably, these copolymers contain no discernible unsaturation, as determined by the aforementioned analytical techniques.

The amine source may be an unsaturated amine compound or an unsaturated carboxylic reagent which is capable of reacting with an amine. The unsaturated carboxylic reagents and amines are described above.

Examples of the basic nitrogen-containing polymers are given in the following references:

| | |
|---|---|
| EP 171,167 | 3,687,905 |
| 3,687,849 | 4,670,173 |
| 3,756,954 | 4,320,012 |
| 4,320,019 | |

(herein incorporated by reference for their disclosure to the basic nitrogen-containing polymers).

(H) A Neutral or Basic Metal Salt

The combination may also include neutral, or basic metal salts. Preferably, the salts include alkali, alkaline earth or transition metal salts. Examples of metals of the salts include sodium, potassium, magnesium, calcium, barium, titanium, manganese, cobalt, nickel, copper, zinc, preferably sodium, potassium, calcium, magnesium, copper and zinc, more preferably zinc or magnesium cation, most preferably zinc.

In one embodiment, the salts are formed from metal compounds which are generally basic salts of metals. Generally, the metal compounds are oxides, hydroxides, chlorides, carbonates, phosphorus acid (phosphonic or phosphoric) salts, and sulfur acid (sulfuric or sulfonic) salts of the metal cations listed above.

Neutral salts are those wherein the number of equivalents of metal and acidic compound are substantially the same. By substantially the same is meant that the amount of metal present ranges from about 0.9 to about 1.1 equivalents of metal per equivalent of acid, preferably from about 0.95 to about 1.05 equivalents of metal per equivalent of acid, more preferably from about 0.99 to about 1.01 equivalents of metal per equivalent of acid.

In another embodiment, the salts are basic salts, generally referred to as overbased salts. Overbased materials are single phase, homogeneous Newtonian systems characterized by a metal content in excess of that which would be present according to the stoichiometry of the metal and the particular organic compound reacted with the metal.

The amount of excess metal is commonly expressed in metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. The basic salts of the present invention have a metal ratio greater than about 1.1, preferably about 1.5, more preferably about 3 up to about 40, preferably up to about 30, more preferably up to about 20.

The methods for preparing the overbased materials as well as an extremely diverse group of overbased materials are well known in the prior art and are disclosed, for example, in the following U.S. Patent Nos.: 2,616,904; 2,616,905; 2,616,906; 3,242,080; 3,250,710; 3,256,186; 3,274,135; 3,492,231; and 4,230,586. These patents disclose processes, materials which can be overbased, suitable metal bases, promoters, and acidic materials, as well as a variety of specific overbased products useful in producing the disperse systems of this invention and are, accordingly, incorporated herein by reference for these disclosures.

The above (D) acylated nitrogen compounds, (E) carboxylic esters, (F) Mannich products and (G) basic nitrogen-containing polymers may be post-treated with one or more post-treating reagents selected from the group consisting of boron compounds (discussed above), carbon disulfide, hydrogen sulfide, sulfur, sulfur chlorides, alkenyl cyanides, carboxylic acid acylating agents, aldehydes, ketones, urea, thiourea, guanidine, dicyanodiamide, hydrocarbyl phosphates, hydrocarbyl phosphites, hydrocarbyl thiophosphates, hydrocarbyl thiophosphites, phosphorus sulfides, phosphorus oxides, phosphoric acid, hydrocarbyl thiocyanates, hydrocarbyl isocyanates, hydrocarbyl isothiocyanates, epoxides, episulfides, formaldehyde or formaldehyde-producing compounds with phenols, and sulfur with phenols.

The following U.S. Patents are expressly incorporated herein by reference for their disclosure of post-treating processes and post-treating reagents applicable to the carboxylic derivative compositions of this invention: U.S. Pat. Nos. 3,087,936; 3,254,025; 3,256,185; 3,278,550; 3,282,955; 3,284,410; 3,338,832; 3,533,945; 3,639,242; 3,708,522; 3,859,318; 3,865,813; etc. U.K. Patent Nos. 1,085,903 and 1,162,436 also describe such processes.

In one embodiment, (D) through (G) are post-treated with at least one boron compound described above. The reaction of the compound with the boron compounds can be effected simply by mixing the reactants at the desired temperature, preferably between about 50° C. and about 250° C. In some instances it may be 25° C. or even lower. The upper limit of the temperature is the decomposition point of the particular reaction mixture and/or product.

The amount of boron compound used to post-treat (D)–(G) generally is sufficient to provide from about 0.1 to about 10 atomic proportions of boron for each equivalent of (D) through (G) such as the atomic proportion of nitrogen or hydroxyl group. The preferred amounts of reactants are such as to provide from about 0.5 to about 2 atomic proportions of boron for each equivalent of nitrogen or hydroxyl group. To illustrate, the amount of a boron compound having one boron atom per molecule to be used with one mole of a acylated nitrogen compound having five nitrogen atoms per molecule is within the range from about 0.1 mole to about 50 moles, preferably from about 0.5 mole to about 10 moles.

The phosphorus and boron containing compositions employed in the grease compositions of the present invention may be prepared by reacting (A) a boron compound and (B) a phospholipid. Further, the composition may be prepared by reacting (A) a boron compound with a mixture of (B) a phospholipid and one of the above-described (C) an amine, (D) an acylated nitrogen compound, (E) a carboxylic ester, (F) a Mannich reaction product and (G) a basic nitrogen-containing polymer or derivatives thereof. The mixture may be simply a mixture of these components or may be a salt or partial salt of these components. In another embodiment, the boron and phosphorus containing composition may be prepared by reacting (A) a boron compound with (B) a phospholipid to form an intermediate reaction product. The intermediate product is then reacted with one of the above-described (C) through (H).

The boron and phosphorus containing compositions of the present invention may be prepared by reacting (A) a boron compound with one of the above-described (C) through (H) to form an intermediate. The intermediate is then reacted with (B) a phospholipid provided that when the acylated nitrogen compound (D) has a substituent with at least an average of 40 carbon atoms, then the boron compound (A) is reacted with the phospholipid (B) to form an intermediate and the intermediate is reacted with (D). When the acylated nitrogen-containing compound contains a substituent with no more than an average of about 40 carbon atoms, it must be understood that the acylated nitrogen-containing compound does not have to have a substituent with an average number of carbon atoms. The substituent may have a specific single number of carbon atoms, e.g. 18 carbon atoms. In one embodiment, the substituent of the acylated nitrogen compound has no more than an average of about 30 carbon atoms. The average number of carbon atoms is based on number average molecular weight.

The reactions usually occurs at a temperature from about 60° C. to about 200° C., about 90° C. to about 150° C. The reaction is typically accomplished in about 0.5 to about 10 hours, preferably about 2 to about 6, more preferably 4. An inert organic diluent, such as benzene, toluene, xylene, or mineral oil may be used.

The boron compound (A) and phospholipid (B) are reacted at an atomic proportion of boron to phosphorus of about (1:1) up to about (6:1), preferably about (2:1) up to about (4:1), more preferably about (3:1).

The boron compound (A) is reacted with the mixture of the phospholipid (B) and one or more of (C) through (H) in an amount of one atomic proportion of boron to equivalent of the mixture from about (1:1) to about (6:1), preferably about (2:1) to about (4:1), more preferably (3:1). The equivalents of the mixture are based on the combined equivalents of phospholipid (B) based on phosphorus and equivalents of (C) through (H). The equivalents of (C) through (G) are determined by the number of nitrogen atoms or hydroxyl groups. The equivalents of (H) are based on base number. Base number is the amount of hydrochloric acid expressed in terms of equivalent milligrams of potassium hydroxide per gram of sample, required to titrate a sample to a defined endpoint. The base number is converted to equivalent weight by the equation: equivalent weight= (56100/base number).

When the phospholipid (B) is reacted with a post-treated product of (C)–(H), then the phospholipid is reacted with the post-treated product at equivalent ratio of about (1:1) up to about (6:1), preferably about (2:1) up to about (4:1), more preferably about (3:1). The equivalents of the post-treated product are based on boron atoms.

The following examples illustrate the preparation of reaction products of a boron compound and a phospholipid. In the following examples as well as in the claims and specification, parts are parts by weight, temperatures are degrees Celsius and pressure is atmospheric pressure unless otherwise indicated.

EXAMPLE 1

A reaction vessel is charged with 2195 parts (1.40 equivalents) of lecithin (a mixed phospholipid product from Central Soya Company of Fort Wayne, Ind., available commercially under the tradename Centrophase (typical analyses: %P= 1.97, %N= 0.75)), 396 parts of a 100 neutral mineral oil, and 260 parts (4.20 moles) of boric acid. The mixture is heated to 90° C. and the temperature is maintained at 90°–95° C. for 0.75 hour. A vacuum is applied and maintained at 160 millimeters of mercury for 2.25 hours during which time the reaction temperature rises from 95° C. to 120° C. and distillate is collected. The vacuum is decreased to 50 millimeters of mercury and the reaction temperature is held for an additional 1.25 hours at 120°– 125° C. (total reaction time equals 3.5 hours), while collecting 151 parts of distillate. A 100 neutral mineral oil (10 parts) is added to the residue and the residue is cooled to 55° C. and filtered through cloth. The filtrate has 1.52% phosphorus, 0.53% nitrogen, 1.78% boron and 15% oil.

EXAMPLE 2

A reaction vessel is charged with a mixture of 2600 parts (1.66 equivalent) of lecithin and 600 parts of toluene. Boric acid (307 parts, 4.97 moles) is added to the mixture over 0.5 hour at 40°–60° C. under nitrogen atmosphere. The reaction mixture is heated to reflux (130° C.) while removing 180 parts of water over 4 hours. A vacuum is applied (20 millimeters of mercury) and toluene solvent removed while raising the reaction temperature to 110° C. The residue is filtered through diatomaceous earth. The filtrate contains 1.78% P (1.88% theory), 0.71% N (0.72% theory) and 2.05% B (2.10% theory).

EXAMPLE 3

A reaction vessel is charged with a mixture of 800 parts (0.5 equivalent) corn lecithin (available as Corn Goodness UB from ADM Ross and Rowe), 150 parts toluene and 141 parts of a 100 neutral mineral oil. Boric acid (104 parts (1.68 moles)) is added over 0.5 hour at 40°–60° C. to the mixture. The reaction mixture is heated to reflux (125°–127° C.) for 4 hours while removing 63 parts distillate.

A vacuum is applied (20 millimeters of mercury) and toluene solvent removed while raising the temperature to 120° C. The residue is filtered through diatomaceous earth. The filtrate contains 1.55% P, 0.62% N, 1.1% B and 15% oil.

EXAMPLE 4

A reaction vessel is charged with 1562 parts (1 equivalent) of a lecithin of Example 1, 200 parts toluene and 560 parts (1 equivalent) of a 40% oil solution of a succinimide, which has 2.5% nitrogen and a total base number of 65 and is prepared by reacting a polyamine with a polyalkene succinic anhydride wherein the polyalkene has a number average molecular weight of approximately 1000. The mixture is heated to 50° C. with nitrogen sparging at 1 scfh where 247 parts (4 moles) of boric acid are added to the mixture over 0.25 hour. The mixture is heated to 120° C. where 25 parts of water are removed over 1.5 hours. The reaction is held at 120°–125° C. for 4.5 hours while 115 milliliters of distillate are obtained. The product is a clear, bright, deep red color. The mixture is vacuum stripped to 80° C. and 25 millimeters of mercury. The residue is a product which has 1.3% phosphorus (1.37% theory), 1.07% nitrogen (1.14% theory), 1.86% boron (1.95% theory), and 15% 100 neutral mineral oil.

EXAMPLE 5

A reaction vessel is charged with 1568 parts (1 equivalent) of the lecithin of Example 1 and 200 parts of textile spirits. The mixture is heated to 60° C. where 525 parts (3 equivalents) of a borated sodium sulfonate prepared by reacting 1 equivalent of boron with 1 equivalent of a sodium overbased alkylated benzene sulfonate having a metal ratio of 20 and containing 36% diluent (including 100 neutral mineral and unreacted alkylated benzene sulfonate) is added to the mixture. The reaction temperature is maintained at 60°–70° C. for 3 hours. The reaction mixture is vacuum stripped to 80° C. and 25 millimeters of mercury. The product contains 1.47% phosphorus (1.49% theory), 3.51% sodium (2.87% theory), 1.52% boron (1.57% theory) and a specific gravity of 1.04.

EXAMPLE 6

A reaction vessel is charged with 784 parts (0.5 equivalent) of the lecithin of Example 1, 124 parts (2.1 equivalents) of boric acid and 449 parts (1 equivalent) of a calcium overbased tall oil fatty acid having a metal ratio of 2, 58% 100 neutral mineral oil and a base number of 125. The mixture is heated to 90° C. and held for 1 hour. The reaction mixture is heated to 120° C. under 140 millimeters of mercury and the reaction is maintained at 120° C. for 1 hour. The reaction mixture is cooled to 60° C. and vacuum stripped at 60° C. and 40 millimeters of mercury. The residue has 1.12% phosphorus (1.19% theory), 1.63% calcium (1.60% theory), 1.97% boron (1.79% theory) and specific gravity of 1.02.

EXAMPLE 7

(A) A reaction vessel is charged with 389 parts (1 equivalent) of a sulfur-coupled tetrapropenyl phenol having 5% sulfur and 42% diluent as mineral oil, 200 parts of toluene and 20 parts (0.25 equivalent) of a 50% aqueous solution of sodium hydroxide. The mixture is stirred and heated to 80° C. where 33 parts (1.0 equivalent) of paraformaldehyde are added to the reaction vessel over 2 minutes and held for one-fourth hour.

(B) A reaction vessel is then charged with 1569 parts (1 equivalent) of the lecithin of Example 1 and 200 parts of toluene. The mixture is warmed to 40° C. where 185 parts (3 equivalents) of boric acid is added to the vessel over one-half hour with stirring. The reaction temperature is increased to 100° C. and maintained for three-fourths of an hour. The product contains 0.63% sulfur (0.67% theory), 1.31% phosphorus (1.37% theory), 1.34% boron (1.45% theory) and 10% 100 neutral mineral oil.

Lubricants

As previously indicated, the reaction products of a boron compound and a phospholipid as described herein are useful as additives for lubricants, including greases, in which they can function as antiwear, extreme pressure and/or friction modifying agents. Additionally, when employed in sufficient amounts, they increase the dropping point of oil based, simple metal soap thickened, base greases. They can be employed in such greases based on diverse oils of lubricating viscosity, including natural and synthetic lubricating oils and mixtures thereof.

The borated phospholipid may be incorporated into the base grease directly or as a component of additive concentrates, by itself or in combination with any other known additives for oil based simple metal soap thickened base greases which include, but are not limited to, antioxidants, anti-wear agents, extreme pressure agents, friction modifiers, anti-rust agents, corrosion inhibitors, and dyes.

Antioxidants, corrosion inhibitors, extreme pressure and anti-wear agents include but are not limited to metal salts of a phosphorus acid, metal salts of a thiophosphorus acid or dithiophosphorus acid; organic sulfides and polysulfides; chlorinated aliphatic hydrocarbons; phosphorus esters including dihydrocarbyl and trihydrocarbyl phosphites; and molybdenum compounds.

Viscosity improvers and pour point depressants are sometimes employed to improve the properties of the oil from which the base grease is derived.

Viscosity improvers include but are not limited to polyisobutenes, polymethyacrylate acid esters, polyacrylate acid esters, diene polymers, polyalkyl styrenes, alkenyl aryl conjugated diene copolymers, polyolefins and multifunctional viscosity improvers.

For some very low temperature applications, the pour point of the oil component of the base grease may be an important consideration. Pour point depressants are sometimes included in the lubricating oils described herein. See for example, page 8 of "Lubricant Additives" by C. V. Smalheer and R. Kennedy Smith (Lesius-Hiles Company Publishers, Cleveland, Ohio, 1967).

These and other additives are described in greater detail in U.S. Pat. No. 4,582,618 (column 14, line 52 through column 17, line 16, inclusive), herein incorporated by reference for its disclosure of other additives that may be used in combination with the present invention.

The additive concentrate might contain 0.01 to 90% by weight of the phosphorus and boron containing compositions employed in the grease compositions of the present invention. The boron and phosphorus containing compositions may be present in the grease compositions of this invention in amounts effective to provide extreme pressure, or antiwear or lubricity properties, preferably in amounts ranging from about 0.1% to about 20%, preferably 0.25% to about 10% by weight, most preferably about 0.5% to about 5%. When the compositions of the present invention are used to increase the dropping point of the base greases, they are used in minor amounts, preferably in amounts ranging from about 0.25% to about 10%, most preferably from about 0.5% up to about 5% by weight of the total grease composition.

As mentioned hereinabove, the boron- and phosphorus-containing compounds which provide increased dropping points of metal soap thickened greases are used in minor amounts effective to increase the dropping point of the base grease by at least 20° C.

Preferred minimum amounts of boron and phosphorus containing compound to employ depend to some extent upon the additive, for example, some higher molecular weight compounds may be needed in somewhat larger amounts to obtain the desired effect.

It generally is not necessary to use more than about 10% by weight of the boron and phosphorus containing compound since usually no additional benefit is obtained and often, deteriorating performance with respect to the dropping point or other characteristics of the grease is observed above this treating level. More often no more than about 5%, frequently no more than about 2% of the boron and phosphorus containing compound is employed. Often 1% by weight is sufficient to provide a 20° C. increase in dropping point.

Thus, it is preferred to use the minimum amount of boron and phosphorus containing additive consistent with attaining the desired effect such as extreme pressure, antiwear, etc. or dropping point elevation of at least 20° C.

The boron- and phosphorus- containing composition may be present during grease formation, i.e., during formation of the soap thickener in the oil of lubricating viscosity, or may be added after the base grease has been prepared. In many cases it is preferred to add the boron and phosphorus containing composition to the preformed base grease.

Other additives may be incorporated into the base grease to improve performance of the grease as a lubricant. Such other additives, including corrosion inhibitors, antioxidants, extreme pressure additives and others useful for improving specific performance characteristics of a base grease, are well-known and will readily occur to those skilled in the art.

The following examples illustrate grease compositions of this invention. It is to be understood that these examples are intended to illustrate the invention and are not intended to be limiting in any way. Dropping points are determined using ASTM Procedure D-2265. All amounts are, unless indicated otherwise, on an oil free basis and are by weight.

EXAMPLE A

A lithium 12-hydroxystearate thickened base grease shows a dropping point of 206° C. This is a typical simple lithium salt thickened base grease.

EXAMPLE B

A base grease is prepared by mixing 92 parts of the base grease of Example A and 8 parts of mineral oil having a kinematic viscosity of 800 Saybolt Universal Seconds (172.6 centistokes) measured at 100° F (37.8° C.). The dropping point of this grease is 204° C.

EXAMPLE C

A grease composition is prepared by blending 4% by weight of the product of Example I into the grease composition of Example B. This grease has a dropping point of 277° C.

EXAMPLE D

A grease composition is prepared by blending 2% by weight of the product of Example 1 into the base grease of Example B. This grease composition has a dropping point of 267° C.

EXAMPLE E

A grease composition is prepared by adding to the base grease of Example B 1% by weight of a composition prepared according to the procedure of Example 1 and 1% by weight of a product obtained by reacting 1000 parts of O,O' (di)methylamyl dithiophosphoric acid prepared by reacting about 4 moles methylamyl alcohol with 1 mole of $P_2S_5$ with 183 parts of propylene oxide, reacting the product obtained thereby with 144 parts of $P_2O_5$ and neutralizing the acidic product thereby with 584 parts of a tertiary alkyl primary amine having from 11–14 carbon atoms in the tertiary alkyl group (Primene 81-R, Rohm and Haas). This grease composition has a dropping point of 272° C.

EXAMPLE F

A grease composition is prepared by adding to the base grease of Example B 1% by weight of a sulfurized isobutylene containing about 45% sulfur and 2% by weight of the product of Example 1. The dropping point of this grease composition is 228.5° C.

EXAMPLE G

To the grease composition of Example F is added 0.1% by weight of Reomet 39, an oil-soluble benzotriazole derivative marketed by Ciba-Geigy. The dropping point of this grease composition is 231° C.

Examples H–M are comparative Examples employing a phophorus containing additive that is free of boron.

EXAMPLE H–I

Grease compositions are prepared by blending into a lithium 12-hydroxystearate base grease having a dropping point of 207° C. the indicated percentages of a mixed phosphoric acid salt prepared by reacting 3 moles (based on OH) of CO1418 alcohol (a primary alcohol containing a mixture of $C_{14}$, $C_{16}$ and $C_{18}$ carbon chains) with 1 mole $P_2O_5$ then reacting the acidic product obtained with 1.13 equivalents of Primene 81-R per equivalent of strong acid.

| Example | % by weight additive | Dropping Point (°C.) |
|---|---|---|
| H | 1.0 | 204° C. |
| I | 1.4 | 198° C. |

EXAMPLES J–L

Grease compositions are prepared by blending into a lithium 12-hydroxystearate base grease the indicated percentages of dibutylhydrogen phosphite ($(Butyl\text{-}O)_2PHO$).

| Example | % by weight additive | Dropping Point (°C.) |
|---|---|---|
| J | 0.35 | 200° C. |
| K | 0.45 | 202° C. |
| L | 0.55 | 197° C. |

EXAMPLE M

A grease composition is prepared by blending into the grease of Example B, 4% by weight of the lecithin described in Example 1. The dropping point of this grease composition is 194° C.

EXAMPLES N–R

Examples C–G are repeated replacing the lithium 12-hydroxy stearate base grease with the corresponding calcium soap thickened base grease.

EXAMPLES S–T

Examples C and G are repeated replacing the lithium 12-hydroxy stearate base grease with a sodium tallowate thickened base grease.

From the foregoing Examples it is apparent that the use of certain boron and phosphorus containing compositions at minimum levels provides enhanced thermal stability as evidenced by increased dropping points compared to the base greases without additive. It is also apparent that phosphorus containing compounds that are substantially free of boron do not provide any significant increase in dropping point.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. An improved grease composition comprising a major amount of an oil based simple metal soap thickened base grease and a minor amount of at least one phosphorus and boron containing composition, said phosphorus and boron containing composition prepared by reacting a combination of (A) at least one boron compound selected from the group consisting of boron oxide, boron oxide hydrate, boron trioxide, boron trifluoride, boron tribromide, boron trichloride, boron acids, boric acid, tetraboric acid, metaboric acid, boron anhydride, boron amide, esters of boron acids and complexes of boron trihalide and (B) at least one phospholipid.

2. The grease composition of claim 1 wherein the simple metal soap is a fatty carboxylic acid salt.

3. The grease composition of claim 1, wherein the simple metal soap is an alkali, an alkaline earth or an aluminum metal soap.

4. The grease composition of claim 3, wherein the simple metal soap is an alkali metal soap.

5. The grease composition of claim 3, wherein the simple metal soap is an alkaline earth metal soap.

6. The grease composition of claim 4 wherein the simple metal soap is a lithium salt.

7. The grease composition of claim 2, wherein the fatty acid is hydroxy-substituted.

8. The grease composition of claim 7 wherein the simple metal soap is a 12-hydroxy stearate.

9. The grease composition of claim 1, wherein the phospholipid (B) is a mono- or diacyl glycerophospholipid.

10. The grease composition of claim 1, wherein the phospholipid (B) is a mono- or a diacyl phosphatidylcholine, phosphatidylethanol, phosphatidylserine, phosphatidylinositol, phosphatidic acid or mixtures thereof.

11. The grease composition of claim 9, wherein each acyl group is independently derived from myristic acid, palmitic acid, stearic acid, oleic acid, linoleic acid, linolenic acid, arachidic acid, arachidonic acid or mixtures thereof.

12. The grease composition of claim 1, wherein the phospholipid (B) is at least one lecithin.

13. The grease composition of claim 12, wherein the phospholipid (B) is a lecithin derived from at least one of soybean, cotton seed, corn, rape seed, sunflower seed, peanut, palm kernel, cucurbit, wheat, barley, rice, olive, mango, avocado, papaya, and carrot.

14. The grease composition of claim 1 wherein the phospholipid is a synthetic phospholipid.

15. The grease composition of claim 1, wherein the composition is prepared by reacting a boron compound (A) with a mixture of phospholipid (B) and an amine (C), a carboxylic ester (E), a Mannich reaction product (F), a basic nitrogen containing polymer (G) or a neutral or basic metal salt of an organic acid (H).

16. The grease composition of claim 1, wherein the phosphorus and boron containing composition is prepared by reacting a boron compound (A) with an amine (C), a carboxylic ester (E), a Mannich reaction product (F), a basic nitrogen containing polymer (G) or a neutral or basic metal salt of an organic acid (H) to form an intermediate, and then reacting the intermediate with a phospholipid (B).

17. An improved grease composition comprising a major amount of an oil based simple metal soap thickened base grease and a minor amount, sufficient to increase the dropping point of the base grease as determined by ASTM procedure D-2265 by at least 20° C., of at least one phosphorus and boron containing composition, said phosphorus and boron containing composition prepared by reacting a combination of (A) at least one boron compound selected from the group consisting of boron oxide, boron oxide hydrate, boron trioxide, boron trifluoride, boron trichloride, boron acids, boric acid, tetraboric acid, metaboric acid, boron anhydride, boron amide, esters of boron acids and complexes of boron trihalide, and (B) at least one phospholipid.

18. The grease composition of claim 17 wherein the simple metal soap is a fatty carboxylic acid salt.

19. The grease composition of claim 17, wherein the simple metal soap is an alkali, an alkaline earth or an aluminum metal soap.

20. The grease composition of claim 19, wherein the simple metal soap is an alkali metal soap.

21. The grease composition of claim 19, wherein the simple metal soap is an alkaline earth metal soap.

22. The grease composition of claim 20, wherein the simple metal soap is a sodium or lithium soap.

23. The grease composition of claim 21, wherein the simple metal soap is a calcium or magnesium soap.

24. The grease composition of claim 18, wherein the fatty acid is a $C_8$ to $C_{24}$ mono-carboxylic acid.

25. The grease composition of claim 18, wherein the fatty acid is hydroxy-substituted.

26. The grease composition of claim 25, wherein the simple metal soap is a 12-hydroxy stearate.

27. The grease composition of claim 17, wherein the phospholipid (B) is a mono- or diacyl glycerophospholipid.

28. The grease composition of claim 17, wherein the phospholipid (B) is a mono- or a diacyl phosphatidylcholine, phosphatidylethanol, phosphatidylserine, phosphatidylinositol, phosphatidic acid or mixtures thereof.

29. The grease composition of claim 27, wherein each acyl group is independently derived from myristic acid, palmitic acid, stearic acid, oleic acid, linoleic acid, linolenic acid, arachidic acid, arachidonic acid or mixtures thereof.

30. The grease composition of claim 17, wherein the phospholipid (B) is at least one lecithin.

31. The grease composition of claim 30, wherein the phospholipid (B) is a lecithin derived from at least one of soybean, cotton seed, corn, rape seed, sunflower seed, peanut, palm kernel, cucurbit, wheat, barley, rice, olive, mango, avocado, papaya, and carrot.

32. The grease composition of claim 17 wherein the phospholipid is a synthetic phospholipid.

33. The grease composition of claim 17, wherein the boron compound (A) is boric acid.

34. The grease composition of claim 17, wherein the composition is prepared by reacting a boron compound (A) with a mixture of a phospholipid (B) and an amine (C), a carboxylic ester (E), a Mannich reaction product (F), a basic nitrogen containing polymer (G) or a neutral or basic metal salt of an organic acid (H).

35. The grease composition of claim 17, wherein the phosphorus and boron containing composition is prepared by reacting a boron compound (A) with an amine (C), a carboxylic ester (E), a Mannich reaction product (F), a basic nitrogen containing polymer (G) or a neutral or basic metal salt of an organic acid (H) to form an intermediate, and then reacting the intermediate with a phospholipid (B) .

36. A method for increasing the dropping point of an oil based simple metal soap thickened base grease by at least about 20° C. as measured by ASTM Procedure D-2265 comprising adding to the base grease a minor amount, based on the total weight of the grease composition, sufficient to increase the dropping point of said base grease by at least 20° C., of a boron and phosphorus containing composition prepared by reacting a combination of (A) at least one boron compound and (B) at least one phospholipid.

* * * * *